US006830306B2

(12) United States Patent
Couwenhoven et al.

(10) Patent No.: US 6,830,306 B2
(45) Date of Patent: Dec. 14, 2004

(54) COMPENSATING FOR DROP VOLUME VARIATION IN AN INKJET PRINTER

(75) Inventors: Douglas W. Couwenhoven, Fairport, NY (US); Steven A. Billow, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 25 days.

(21) Appl. No.: 10/430,821

(22) Filed: May 6, 2003

(65) Prior Publication Data

US 2004/0223015 A1 Nov. 11, 2004

(51) Int. Cl.[7] ..... B41J 29/38; B41J 29/393
(52) U.S. Cl. ..... 347/12; 347/14; 347/19
(58) Field of Search ..... 347/12, 19, 15, 347/13, 40–43

(56) References Cited

U.S. PATENT DOCUMENTS 4,967,203 A 10/1990 Doan et al.
5,714,990 A * 2/1998 Courtney ..... 347/14
5,812,156 A 9/1998 Bullock et al.
5,992,962 A 11/1999 Yen et al.
6,154,227 A 11/2000 Lund
6,273,542 B1 8/2001 Couwenhoven et al.
6,312,078 B1 11/2001 Wen
6,315,383 B1 11/2001 Sarmast et al.
6,354,689 B1 3/2002 Couwenhoven et al.
6,428,134 B1 8/2002 Clark et al.
6,450,608 B2 9/2002 Sarmast et al.
6,508,531 B1 * 1/2003 Gargir ..... 347/19

* cited by examiner

*Primary Examiner*—Stephen D. Meier
*Assistant Examiner*—An H. Do
(74) *Attorney, Agent, or Firm*—Raymond L. Owens

(57) ABSTRACT

A method for modifying a digital image having an array of raster lines, each raster line having an array of image pixels, to produce a modified digital image suitable for printing on an inkjet printer containing at least one printhead having nozzles, such that unwanted optical density variations in the print are reduced, includes determining an optical density parameter for each nozzle in the printhead; determining a line correction factor for a given raster line in response to the optical density parameter for each nozzle in the printhead and the raster line number; and modifying each pixel in the given raster line in response to the line correction factor to produce the modified digital image.

14 Claims, 8 Drawing Sheets

COMPENSATING FOR DROP VOLUME VARIATION IN AN INKJET PRINTER

CROSS REFERENCE TO RELATED APPLICATIONS

Reference is made to commonly assigned U.S. patent application Ser. No. 10/365,843 filed Feb. 13, 2003, entitled "Actuator-Bank Matching in an Inkjet Printer With Multiple Actuator Banks for a Single Colorant" to Steven A. Billow et al., the disclosure of which is incorporated herein by reference.

FIELD OF THE INVENTION

This invention pertains to the field of digital printing, and more particularly to a method of compensating for ink drop volume variation in an inkjet printhead.

BACKGROUND OF THE INVENTION

An ink jet printer produces images on a receiver by ejecting ink droplets onto the receiver in a raster scanning fashion. The advantages of non-impact, low noise, low energy use, and low cost operation in addition to the capability of the printer to print on plain paper are largely responsible for the wide acceptance of ink jet printers in the marketplace.

A typical inkjet printer uses one printhead for each color of ink, where each printhead contains an array of individual nozzles for ejecting drops of ink onto the page. The nozzles are typically activated to produce ink drops on demand at the control of a host computer, which processes raster image data and sends it to the printer through a cable connection. It is known to those skilled in the art that undesirable image artifacts can arise due to small differences between the individual nozzles in a printhead. These differences, often caused by slight variations in the manufacturing process, can cause the ink drops ejected from one nozzle to follow a trajectory that is slightly different from neighboring nozzles. Also, each nozzle may produce ink drops that are slightly different in volume from neighboring nozzles. Larger ink drops will result in darker (increased optical density) areas on the printed page, and smaller ink drops will result in lighter (decreased optical density) areas. Due to the raster scanning fashion of the printhead, these dark and light areas will form lines of darker and lighter density often referred to as "banding", which is generally quite undesirable and results in a poor quality print.

There are many techniques present in the prior art that describe methods of reducing banding artifacts caused by nozzle-to-nozzle differences using methods referred to as "interlacing", "print masking", or "multipass printing". These techniques employ methods of advancing the paper by an increment less than the printhead width, so that successive passes or swaths of the printhead overlap. This has the effect that each image raster line may be printed using more than one nozzle, and drop volume or drop trajectory errors observed in a given printed raster line are reduced because the nozzle-to-nozzle differences are averaged out as the number of nozzles used to print each raster line increases. See, for example, U.S. Pat. Nos. 4,967,203 and 5,992,962. Other methods known in the art take advantage of multipass printing to reduce banding by using operative nozzles to compensate for failed or malperforming nozzles. For example, U.S. Pat. Nos. 6,354,689 and 6,273,542 to Couwenhoven et al., teach methods of correcting for malperforming nozzles that have trajectory or drop volume errors in a multipass inkjet printer wherein other nozzles that print along substantially the same raster line as the malperforming nozzle are used instead of the malperforming nozzle. However, the above mentioned methods provide for reduced banding artifacts at the cost of increased print time, since the effective number of nozzles in the printhead is reduced by a factor equal to the number of print passes. Also, many of the prior art techniques described above rely on the performance of the individual ink nozzles being fairly uncorrelated. In other words, if four different nozzles are used to print a given raster line, then the banding artifacts will be reduced only if those four nozzles had different drop volume characteristics. If all four of those nozzles happen to eject ink drops that were larger than average, then an improvement in banding will not be observed, and a significant penalty will be paid in terms of increased print time. Such instances can occur if the-nozzle-to-nozzle variation changes slowly across the printhead.

Other techniques known in the art attempt to correct for drop volume variation by modifying the electrical signals that are used to activate the individual nozzles. For example, U.S. Pat. No. 6,428,134 to Clark et al., teaches a method of constructing waveforms for driving a piezoelectric inkjet printhead to reduce ink drop volume variability. Similarly, U.S. Pat. No. 6,312,078 to Wen et al. teaches a method of reducing ink drop volume variability by modifying the drive voltage used to activate the nozzle.

Still other techniques known in the prior art address drop volume variability issues between printheads. For example, U.S. Pat. No. 6,154,227 to Lund teaches a method of adjusting the number of microdrops printed in response to a drop volume parameter stored in programmable memory on the printhead cartridge. This method reduces print density variation from printhead to printhead, but does not address print density variation from nozzle to nozzle within a printhead. U.S. Pat. No. 5,812,156 to Bullock et al., teaches a method of using drop volume information to determine ink usage in an inkjet printhead cartridge, and warn the user when the cartridge is running low on ink. This method includes storing ink drop volume information in programmable memory on the cartridge, but does not teach characterizing the drop volume produced by individual nozzles, nor how that information may he used to correct image artifacts. Also, U.S. Pat. Nos. 6,450,608 and 6,315,383 to Sarmast et al., teach methods of detecting inkjet nozzle trajectory errors and drop volume using a two-dimensional array of individual detectors.

The inkjet printing market continues to require faster and faster printing of images, and many modifications to the basic inkjet printing engine have been investigated to accommodate this requirement. One method of printing an image faster is to use a printhead that has more nozzles. This prints more image raster lines in each movement of the printhead, thereby increasing the throughput of the printer. However, manufacturing and technical challenges prevent the creation of printheads with large numbers of nozzles. Thus, in some state of the art inkjet printers designed for high throughput, several smaller printheads have been assembled into a single printhead "module" that effectively increases the number of nozzles, but uses smaller printheads that are easier to manufacture. In this arrangement, it is not uncommon for the above described image artifacts associated with drop volume variation to become amplified. This is due to the fact that combining several smaller printheads into a single larger module often results in slowly varying nozzle-to-nozzle differences, which the prior art techniques are ill-equipped to handle.

Thus, there is a need for a method of reducing image artifacts associated with slowly varying nozzle-to-nozzle variability, while simultaneously maintaining high image quality and short print times.

SUMMARY OF THE INVENTION

It is an object of the present invention to provide for printing high quality digital images that are free of the above-described artifacts associated with slowly varying nozzle-to-nozzle variability.

This object is achieved by a method for modifying a digital image having an array of raster lines, each raster line having an array of image pixels, to produce a modified digital image suitable for printing on an inkjet printer containing at least one printhead having nozzles, such that unwanted optical density variations in the print are reduced, comprising:

a) determining an optical density parameter for each nozzle in the printhead;

b) determining a line correction factor for a given raster line in response to the optical density parameter for each nozzle in the printhead and the raster line number; and c) modifying each pixel in the given raster line in response to the line correction factor to produce the modified digital image.

The present invention has an advantage in that it provides for a method of reducing undesirable banding artifacts in an image printed with a printhead that has slowly varying nozzle-to-nozzle variability.

Another advantage of the present invention is that it provides for short printing times by reducing the number of banding passes required to achieve high print quality.

Yet another advantage of the present invention is that a high quality print is achievable with a previously unacceptable printhead. This increases the manufacturing yield of acceptable printheads from the factory.

DETAILED DESCRIPTION OF THE INVENTION

This invention presents a method for compensating for drop volume variability in an inkjet printer. In particular, the present invention is most effective when applied to an inkjet printhead wherein the drop volume varies slowly from nozzle to nozzle, and there are several reasons why this may occur.

As mentioned above, several smaller printheads may be combined into a larger printhead module to increase the number of effective nozzles. This results in improved throughput, which is a significant market advantage. However, each small printhead can have slightly different drop volume characteristics, not only from printhead to printhead, but also nozzle to nozzle. Also, the characteristics of the ink supply system to the printhead may result in unequal ink pressure from one end of the printhead to the other. These design characteristics in combination can result in a slowly varying drop volume from nozzle to nozzle. Since the variation in drop volume varies slowly from one end of the printhead to the other, then the variation in optical density in the printed image has a spatial frequency similar to the height of the printhead, which is typically on the order of 1 inch. Banding at this frequency is extremely objectionable to a human observer, especially when the print is a large format, such as a sign or poster that is viewed at considerable distance.

Figure 1:
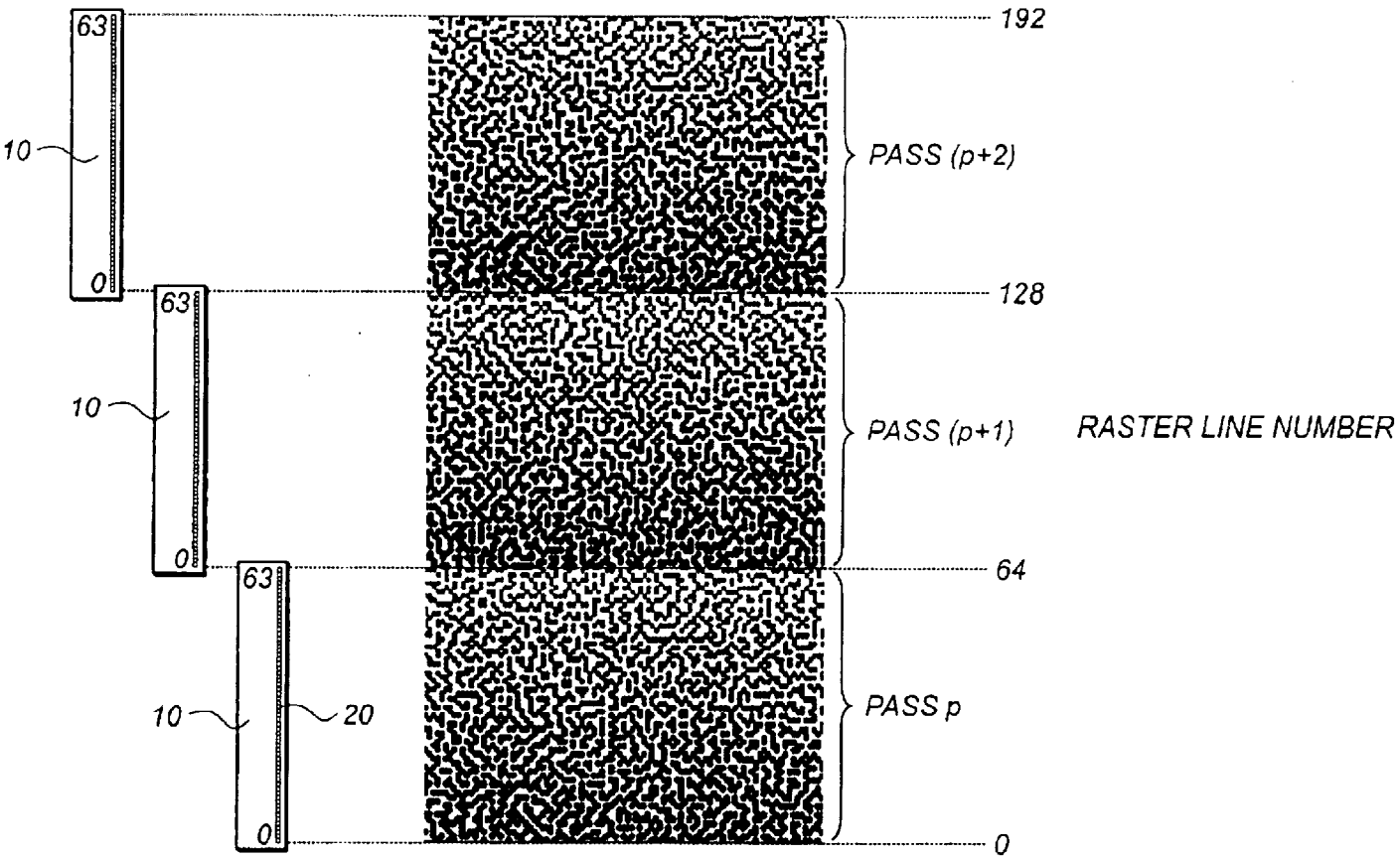
FIG. 1 (PRIOR ART)
FIG. 1 is diagram showing an image with banding artifacts produced by the prior art.
Figure 2:
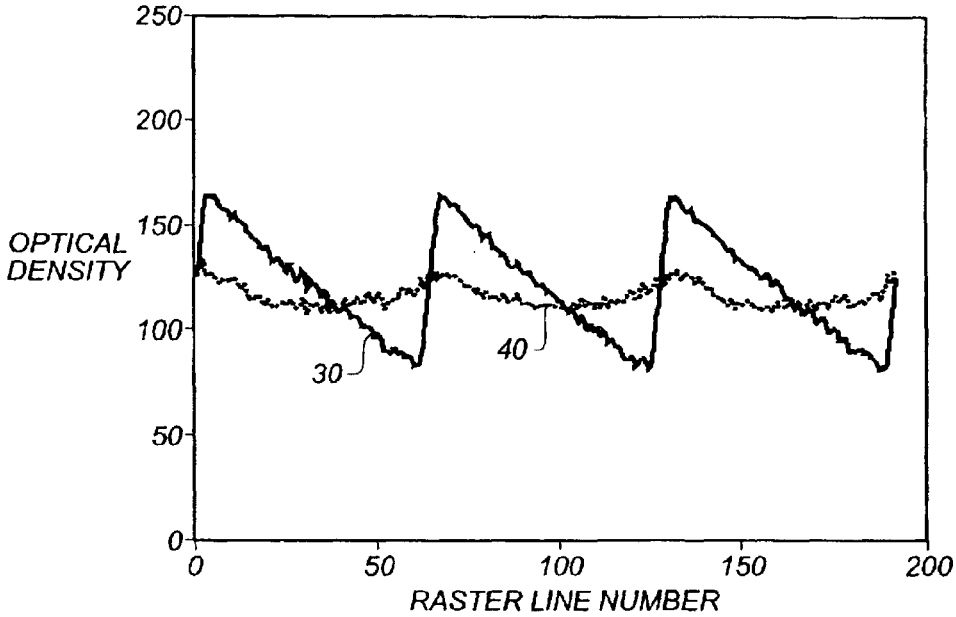
FIG. 2 is a plot showing optical density vs. raster line number corresponding to the prior art image of FIG. 1, and showing optical density vs. raster line number corresponding to the corrected image of FIG. 6 in accordance with the present invention.

Referring to FIG. 1, consider a printhead 10 which has an array of 64 individual nozzles 20 numbered 0 to 63 from bottom to top, and wherein the drop volume produced by these 64 nozzles varies slowly from one end of the printhead to the other. Assume that the nozzles near the bottom of the printhead 10 produce drops that are larger than the average drop volume, and the nozzles near the top of the printhead 10 produce drops that are smaller than the average drop volume. Thus, an attempt to print a uniform gray image results in an unwanted optical density variation, shown as a vertical gradient across the image as shown in the figure. In a single pass printmode, the printhead 10 is moved horizontally across a stationary page, and then the page is advanced vertically a distance equal to the printhead height. Each horizontal motion of the printhead is called a print pass, and FIG. 1 shows three subsequent print passes (p, p+1, p+2) of the printhead 10. As can be seen from the figure, an objectionable density step is observed near the boundary between the print passes, which occur near image raster lines 64 and 128. The term "raster line" refers to a line of image pixels. This is graphically shown in FIG. 2, which shows a plot of optical density vs. raster line number corresponding to the image of FIG. 1 as a solid line 30.

Figure 3:
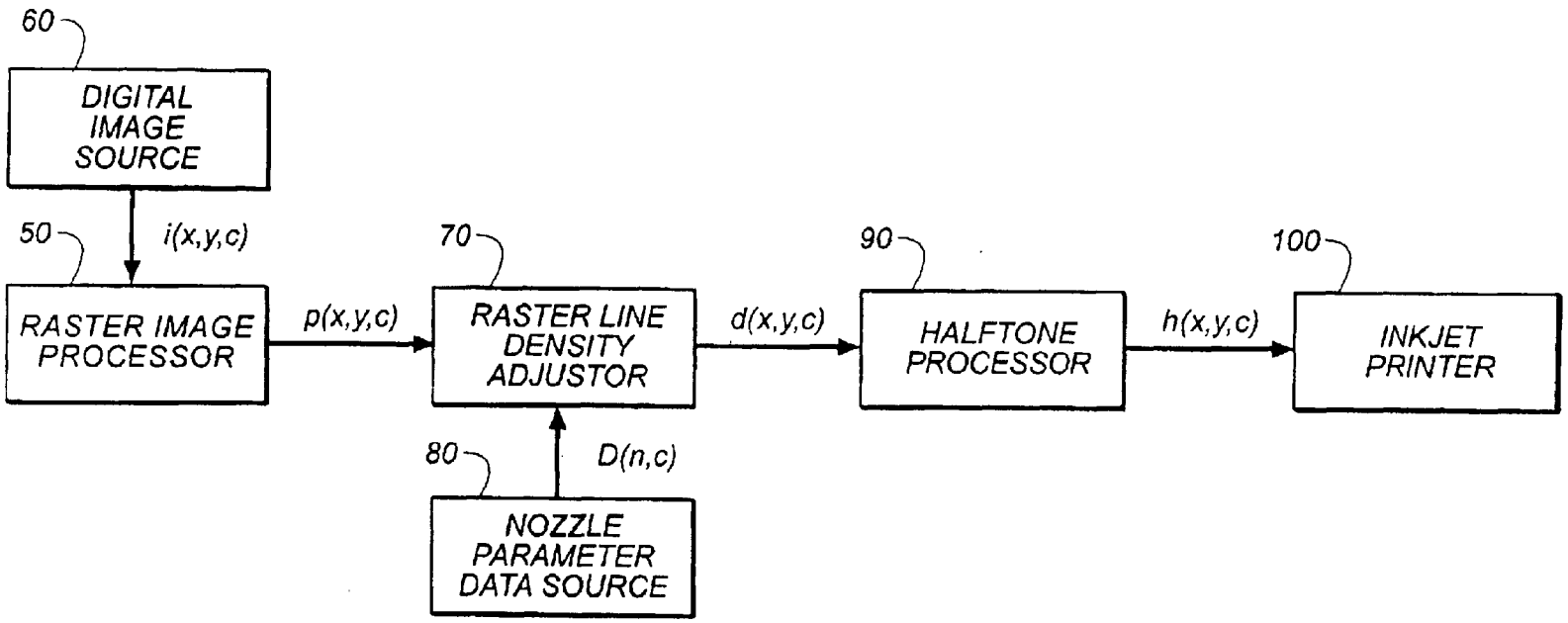
FIG. 3 is a block diagram showing the image processing operations of the present invention in an inkjet printer driver.

Turning now to FIG. 3, a block diagram of a typical image processing chain implemented in an inkjet printer driver is shown. The printer driver typically runs on a host computer (not shown), which processes digital image data from a digital image source 60 and sends it to an inkjet printer 100, usually via a cable connection. The digital image source 60 may be a digital camera, scanner, computer disk file, or any other source of digital imagery. Typically, the digital image is represented in the host computer as a set of color planes (often red, green, and blue), where each color plane is a two-dimensional array of image pixels. Each image pixel is commonly represented as an integer code value on the range 0–255, where the magnitude of the code value represents the intensity of the corresponding color plane at this pixel location. The image data supplied by the digital image source 60 is shown in FIG. 3 as a signal i(x,y,c), where (x,y) are spatial coordinates representing the horizontal and vertical (respectively) location of the sampled pixel, and c indicates the color plane. A raster image processor 50 receives the digital image i(x,y,c) and produces a processed digital image p(x,y,c). The raster image processor 50 applies several image processing functions such as sharpening, color correction, and resizing or interpolation. The overall structure of the image processing block diagram of FIG. 3, as well as the individual image processing algorithms just mentioned, will be well known to one skilled in the art.

Still referring to FIG. 3, the processed digital image p(x,y,c) is received by a raster line density adjuster 70, which produces a modified digital image d(x,y,c). The raster line density adjuster 70 also receives nozzle parameter data D(n,c) (where n is the nozzle number and c is the color, which indicates the printhead that the data pertains to) from a nozzle parameter data source 80. The function of the raster line density adjuster 70 is to modify the processed digital image p(x,y,c) using the nozzle parameter data D(n,c) so as to compensate for line to line density variation caused by the printhead. The raster line density adjuster 70 and the nozzle parameter data source 80 constitute the main function of the present invention, and will be discussed in detail below. After being corrected by the raster line density adjuster 70, the modified digital image d(x,y,c) is received by a halftone processor 90, which produces a halftoned image h(x,y,c). The halftone processor 90 reduces the number of gray levels per pixel to match the number of gray levels reproducible by the inkjet printer 100 at each pixel (often 2, corresponding to 0 or 1 drops of ink). The process of halftoning is well known to those skilled in the art, and the particular halftone algorithm that is used in the halftone processor 90 is not fundamental to the invention. It should be noted that many inkjet printers can produce more than 1 drop of ink per pixel (per color), and that the present invention will apply equally to printers adapted to print any number of gray levels. It is also important to note that the raster line density adjuster 70 modifies the digital image prior to the halftone processor 90. This represents a significant departure from the prior art.

The details of raster line density adjuster 70 and nozzle parameter data source 80 of FIG. 3 will now be discussed. The nozzle parameter data source 80 provides nozzle parameter data D(n,c), where n is the nozzle number and c is the color plane. The value of D(n,c) is a normalized optical density parameter that indicates the relative optical density that will be produced by nozzle n (for color c) compared to other nozzles. For example, assume that nozzle 3 produces ink drops that are 10% larger than average, resulting in an optical density of a printed raster line that is 18% higher than average (for example, the increase in optical density as a function of drop volume increase will be ink and receiver media dependent). In a preferred embodiment of the present invention, the optical density parameter for nozzle 3 is set to a normalized optical density value of 1.18, indicating the 18% increase in density to be expected for a raster line printed with this nozzle relative to a raster line printed with other nozzles. In this case, the normalized optical density parameter for the nozzle is computed as the optical density produced by the nozzle divided by the average optical density produced by all nozzles. Other measures of the optical density parameter are also appropriate within the scope of the present invention. In another embodiment of the present invention, the optical density parameter for nozzle 3 is set to 1.10, indicating the 10% increase in drop volume associated this nozzle. In this case, the optical density parameter is a function of the average drop volume produced by the nozzle divided by the average drop volume produced by all nozzles. Using drop volume as the optical density parameter has the advantage that it is not dependent on the receiver media. Yet another embodiment of the present invention uses the measured dot size as the optical density parameter. In this case, the optical density parameter is a function of the average dot size produced by the nozzle divided by the average dot size produced by all nozzles. This will also be media dependent, but is likely easier to measure than raster line optical density. The optical density parameters may be determined using a number of techniques that will be known to those skilled in the art. For example, a high resolution scanner may be used to measure the optical density or dot size produced by a raster line printed with each nozzle. This information is then supplied by the nozzle parameter data source 80 for each nozzle of each printhead in the printer.

Figure 4:
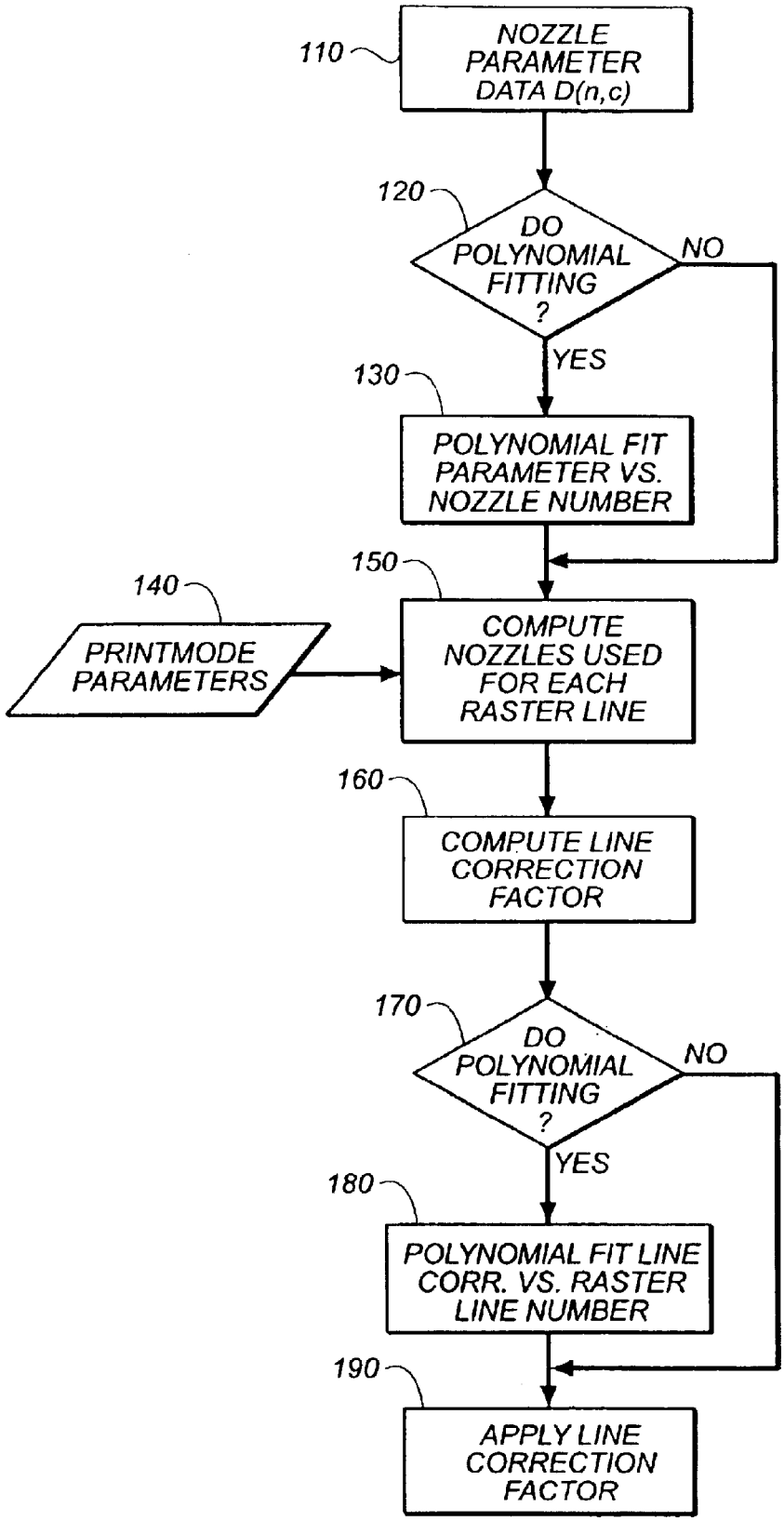
FIG. 4 is a flowchart showing the steps of the raster line density adjuster of FIG. 3.

The details of the raster line density adjuster 70 of FIG. 3 will now be discussed. The processing performed by the raster line density adjuster 70 of FIG. 3 are shown as a flowchart in FIG. 4. Turning to FIG. 4, the nozzle parameter data D(n,c) supplied by the nozzle parameter data source 80 is received in step 110. Recall that the nozzle parameter data that is recorded for each nozzle may be the normalized drop volume, dot size, or optical density of a raster line printed with that nozzle. In general, when examined as a function of the nozzle number, the nozzle parameter data will contain both slowly varying and quickly varying components. The slowly varying component arises from manufacturing errors, and is the cause of the objectionable low frequency banding that the present invention seeks to correct for. Typically, the high frequency components will represent measurement noise or other non-repeatable characteristics that should be discounted. However, because all printheads are different, there may be cases where high frequency components are consistently present, and desired to be corrected for as well. For this reason, the user can elect whether or not correct for high frequency components using a polynomial fitting decision step 120. If the user elects to perform polynomial fitting, then the nozzle parameter data D(n,c) is fit as a function of the nozzle number n using a polynomial fitting step 130. In a preferred embodiment, the degree of the polynomial fit is 2, which provides a quadratic function to estimate the nozzle parameter data as a function of the nozzle number. This provides for a good amount of smoothing to filter out unwanted high frequency measurement noise, while capturing low frequency trends that give rise to the objectionable banding. If enabled, the polynomial fitting step 130 is performed independently on each printhead, and the optical density parameter for each nozzle is replaced with the value of the polynomial fit evaluated at the nozzle number. Analysis of printheads containing multiple columns of nozzles (typically two columns containing odd numbered and even numbered nozzles) have shown that the low frequency variation of the nozzle parameter data D(n,c) is different between the nozzle columns due to the specifics of the manufacturing process. For such printheads, significant benefit is gained by polynomial fitting each nozzle column separately. Similarly, printhead modules that contain several smaller printheads combined together should have polynomial fits applied to each printhead individually, as each printhead will likely have different low frequency variations due to the manufacturing process. Returning to the polynomial fitting decision step 120, if the user elects not to fit the nozzle parameter data D(n,c) with a polynomial to filter out the high frequency components, then the nozzle parameter data D(n,c) is passed directly on to the next step.

Still referring to FIG. 4, the next step in the process of the raster line density adjuster 70 of FIG. 3 is to compute which nozzles are used to print a given raster line of the image in step 150. This step requires knowledge of printmode parameters 140, which include particular parameters of the inkjet printer such as the print masking and page advance parameters. These parameters will be known and understood by one skilled in the art as required to compute exactly which nozzle will be used to print a given pixel in the image. As mentioned earlier, in a multipass inkjet printer, more than one nozzle is often used to print a given raster line. The number of different nozzles that are used to print a given raster line is often equivalent to the number of print passes. The particular sequence or patterns of which nozzles print which pixels in a given raster line is not significant to the invention, it is only required to know the set of nozzles that will be used to print each raster line. Since the printhead has a finite number of nozzles, N, then the set of nozzles that is used to print each raster line typically repeats every N raster lines. For example, consider a N=100 nozzle (numbered 0 to 99) printhead printing in a two pass printmode. In a two pass printmode, the paper is advanced a distance equal to half the printhead height after each pass. Thus, two nozzles will be used to print each raster line. The first raster line of the image (line 0) will be printed with nozzles 0 and 50, line 1 will be printed with nozzles 1 and 51, etc., and line 99 will be printed with nozzles 49 and 99. Line 100 is then printed with nozzles 0 and 50 again, and the pattern repeats. Thus, it is typically not required to compute the set of nozzles that are used for every raster line in the image; only the first N sets corresponding to the first N raster lines need to be computed, and the pattern repeats after that. It should be noted that some printmodes are possible that contain non-repeating patterns of nozzles used to print each raster line. In these cases, the set of nozzles used must be computed for each raster line of the image.

Still referring to FIG. 4, the set of nozzles used to print a given raster line are supplied to a compute line correction factor step 160. This step computes a line correction factor for each raster line that will be used to adjust the image data to compensate for nozzle-to-nozzle variation. In a preferred embodiment, an average optical density parameter for a given raster line is computed according to:

$$A(y, c) = \left[\frac{1}{N_p}\sum_{p=1}^{N_p} D(n_p(y), c)\right]$$

where

D(n,c)=optical density parameter for nozzle n, color c $n_p(y)$=the nozzles number used to print raster line y on pass p $N_p$=number of print passes A(y,c)=average optical density parameter for raster line y, color c.

Thus, the average optical density parameter A(y,c) will be an estimate of the optical density, drop volume, or dot size corresponding to raster line y, color c, depending on which measurement was used as the nozzle parameter data D(n,c). The line correction factor is then computed according to:

$$f(y,c)=[A(y,c)]^{-1}$$

where

A(y,c)=average optical density parameter for raster line y, color c f(y,c)=line correction factor for raster line y, color c.

The inverse relationship between the line correction factor and the average optical density parameter shown in the above equation prescribes that raster lines with higher than average optical density will have a lower line correction factor, and raster lines with lower than average optical density will have a higher line correction factor. As was done earlier with the nozzle parameter data, an optional polynomial fitting step 180 is enabled or disabled by the user using a polynomial fitting decision step 170. If enabled, step 180 computes a polynomial fit of line correction factor vs. raster line number for a group of raster lines surrounding the current raster line, and replaces the line correction factor f(y,c) with the value of the polynomial fit. If a polynomial fit is not desired, then the line correction factors are supplied directly to the next step.

Again referring to FIG. 4, the line correction factor is applied to the image data in step 190. In a preferred embodiment, the pixel values in a given raster line of the image are multiplied by the corresponding line correction factor, according to:

$$d(x,y,c)=p(x,y,c)f(y,c)$$

where f(y c)=line correction factor for raster line y, color c d(x,y,c)=modified digital image pixel for location (x,y), color c p(x,y,c)=processed digital image pixel for location (x,y), color c.

Figure 5:
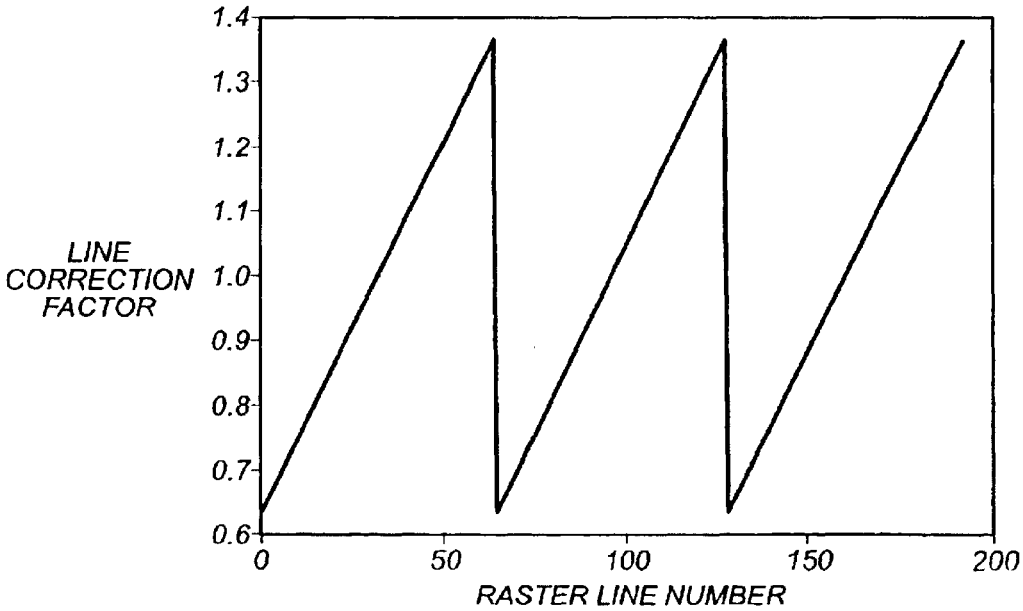
FIG. 5 is a plot in accordance with the present invention showing the line correction factor vs. raster line number for the image of FIG. 1.
Figure 6:
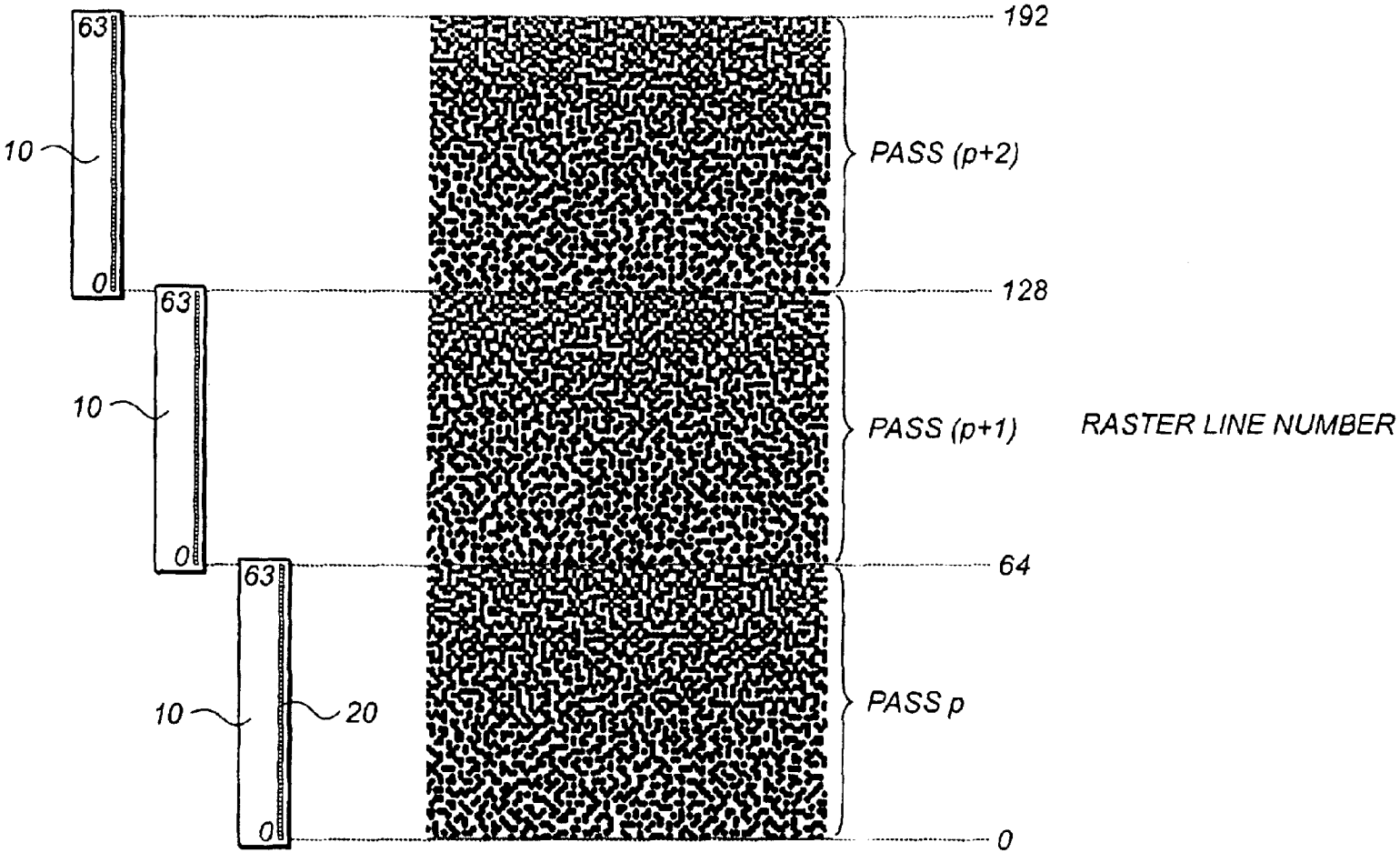
FIG. 6 is a diagram showing a corrected version of the image of FIG. 1 according to the method of the present invention.

A plot of the line correction factor vs. raster line number for the printhead 10 of FIG. 1 is shown in FIG. 5. Recall that the printhead 10 has nozzles at one end of the printhead that eject drops of larger than average volume, and nozzles at the opposite end of the printhead that eject drops of smaller than average volume. This resulted in the low frequency optical density variations that are plotted as the solid line 30 of FIG. 2. Note that the polarity of the line correction factor shown in FIG. 5 is inverted from the optical density of the solid line 30 in FIG. 2, as prescribed by the equations above. When the line correction factor shown in FIG. 5 is applied to the digital image, the printed output appears as shown in FIG. 6. Note that the objectionable density gradient observed in FIG. 1 is significantly reduced, producing a smoother, more uniform tone as observed in FIG. 6. A key to understanding the nature of the present invention is that the drop volume produced by each of the nozzles has not changed, but due to the pre-halftone correction that was applied to the raster image data, there are several more dots present on raster lines printed with nozzles having smaller than average drops (such as nozzle 63), and several fewer dots present on raster lines printed with nozzles having larger than average drops (such as nozzle 0). This causes an equalization of the raster line optical density across the printhead, providing for the smooth, uniform appearance to the image of FIG. 6. A plot of the optical density vs. raster line number corresponding to the image of FIG. 6 is shown as a dotted line 40 in FIG. 2. Note that the amplitude of the optical density variation is significantly reduced.

Figure 7:
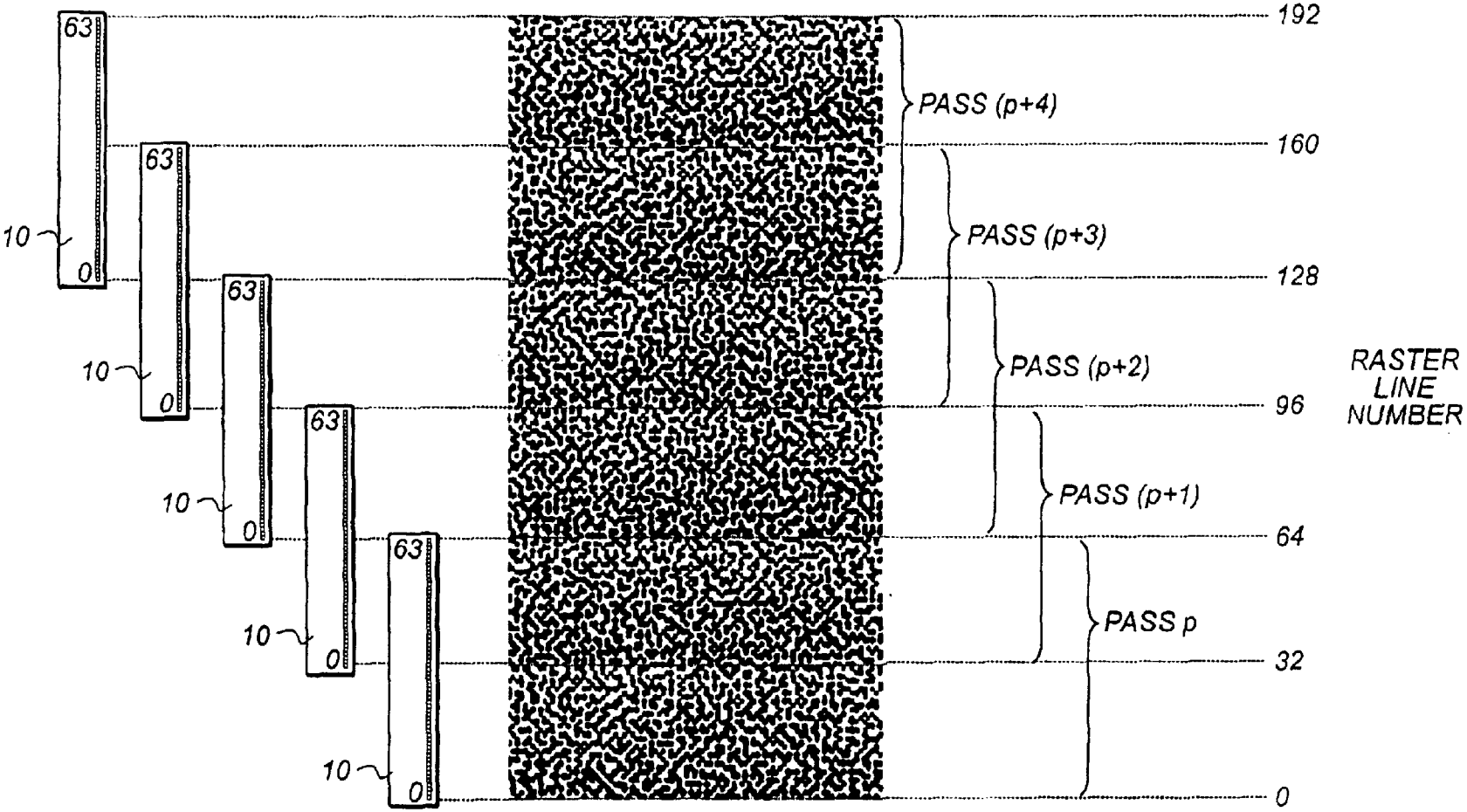
FIG. 7 (PRIOR ART)
FIG. 7 is a diagram showing an image with banding artifacts produced by the prior art.
Figure 8:
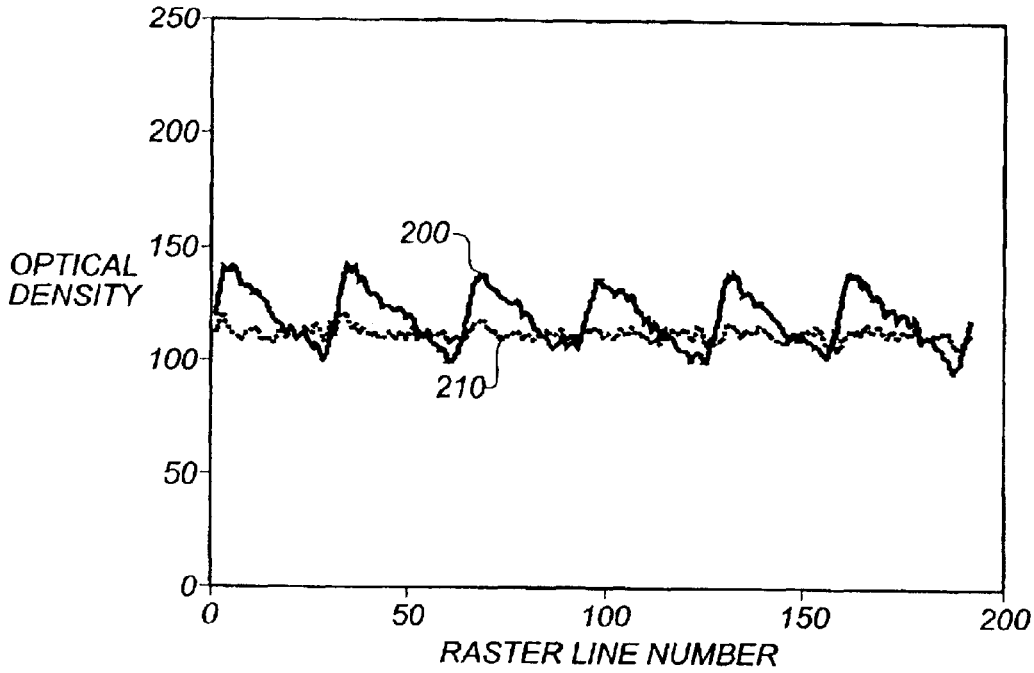
FIG. 8 is a plot showing optical density vs. raster line number corresponding to the prior art image of FIG. 7, and showing optical density vs. raster line number corresponding to the corrected image of FIG. 10 in accordance with the present invention.
Figure 9:
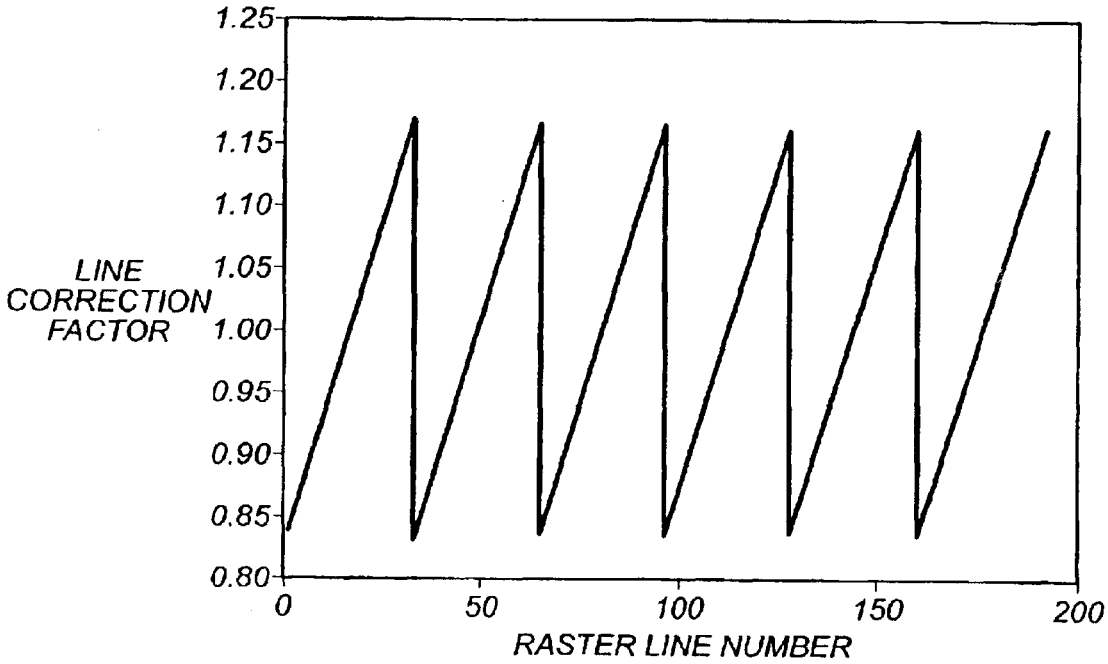
FIG. 9 is a plot in accordance with the present invention showing the line correction factor vs. raster line number corresponding to the image of FIG. 7.
Figure 10:
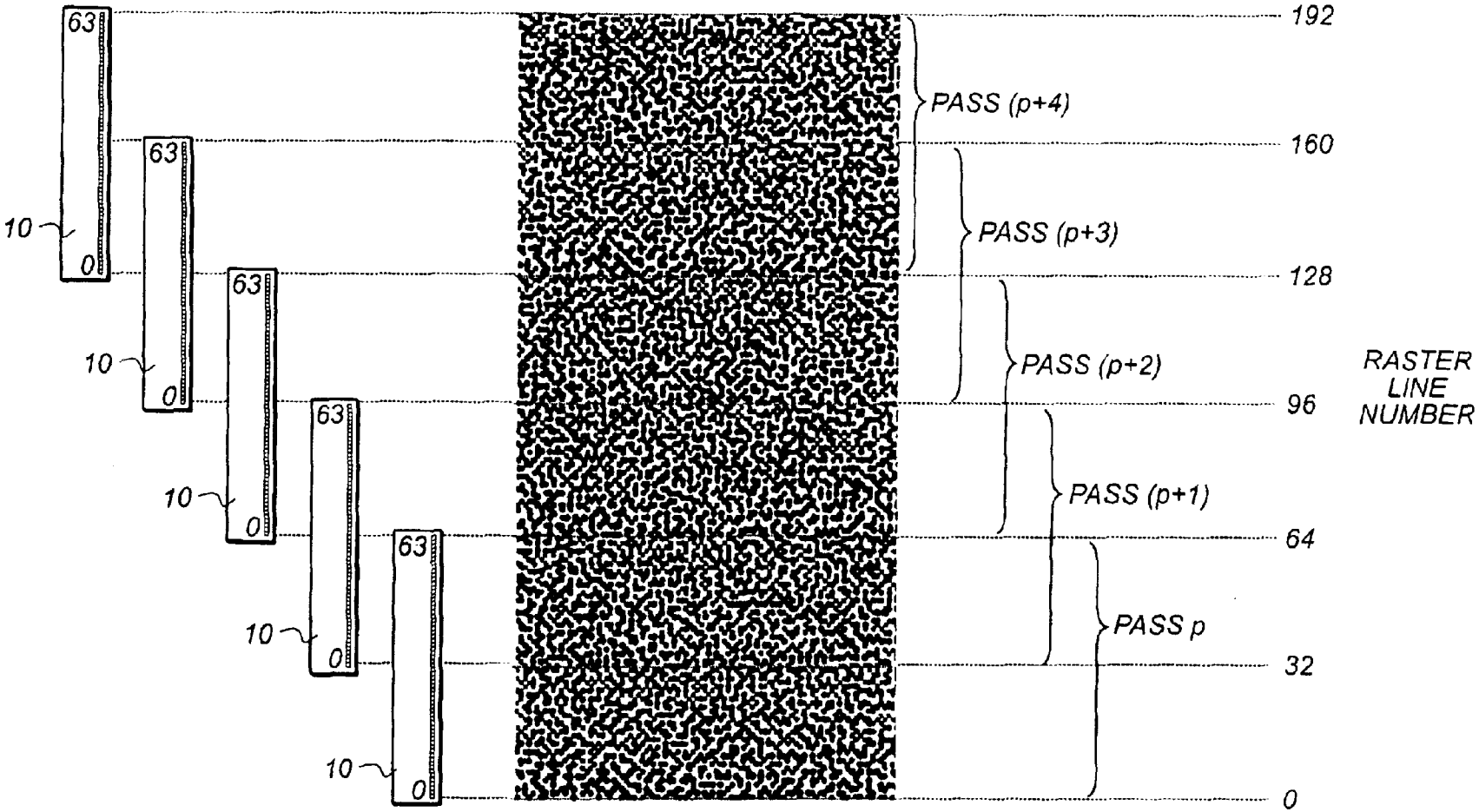
FIG. 10 is a diagram showing a corrected version of the image of FIG. 7 according to the method of the present invention.

As another example, consider that the printhead 10 is used to print in a two pass printmode as shown in FIG. 7. In this case, the paper is advanced vertically by a distance equal to one half of the printhead height after each print pass. This means (hat two different nozzles will be used to print each raster line in the image. Note that the objectionable density gradient has doubled in frequency (now having 6 cycles vs. 3 in the same distance), and diminished somewhat in magnitude due to the averaging effect of using two different nozzles per raster line, but that density gradient is still present and objectionable. A plot of the optical density vs., raster line number corresponding to the image of FIG. 7 is shown as a solid line 200 of FIG. 8. Applying the method of the present invention results in a line correction factor as shown in FIG. 9, and the corrected image is shown in FIG. 10. A plot of the optical density vs. raster line number corresponding to the image of FIG. 10 is shown as a dotted line 210 of FIG. 8. Again, note that the magnitude of the optical density variation is significantly reduced, resulting in an improved quality image.

The invention is described hereinafter in the context of an inkjet printer. However, it should be recognized that this method is applicable to other printing technologies as well. For example, the present invention could be equally applied to one or more color channels of a color inkjet printer having multiple colorants.

The invention has been described in detail with particular reference to certain preferred embodiments thereof, but it will be understood that variations and modifications can be effected within the spirit and scope of the invention.

PARTS LIST

10 printhead
20 nozzles
30 uncorrected optical density curve
40 corrected optical density curve
50 raster image processor
60 digital image source
70 raster line density adjuster
80 nozzle parameter data source
90 halftone processor
100 inkjet printer
110 nozzle parameter data receiving step
120 polynomial fitting decision step
130 polynomial fitting step
140 printmode parameters
150 compute nozzles step
160 compute line correction factor step
170 polynomial fitting decision step
180 polynomial fitting step
190 apply line correction step
200 uncorrected optical density curve
210 corrected optical density curve

What is claimed is:

1. A method for modifying a digital image having an array of raster lines, each raster line having an array of image pixels, to produce a modified digital image suitable for printing on an inkjet printer containing at least one printhead having nozzles each of which when activated is adapted to produce one or more ink drops in a raster line, such that unwanted optical density variations in the print are reduced, comprising:

a) determining an optical density parameter for each nozzle in the printhead;

b) determining a line correction factor for a given raster line in response to the optical density parameter for each nozzle in the printhead and the raster line number; and c) modifying the number of ink drops produced each pixel in the given raster line by reducing or increasing the number of ink drops provided by the nozzle in response to the line correction factor to produce the modified digital image.

2. The method of claim 1 wherein element b) further includes:

i) determining a set of nozzles that are used to print the pixels in the given raster line; and ii) determining the line correction factor for the given raster line in response to the determined set of nozzles and the corresponding optical density parameters.

3. The method of claim 2 wherein the line correction factor is determined as the inverse of the average optical density parameter for the set of nozzles.

4. The method of claim 1 wherein the optical density parameter for each nozzle is a function of the average drop volume produced by the nozzle.

5. The method of claim 1 wherein the optical density parameter for each nozzle is the average drop volume produced by the nozzle divided by the average drop volume produced by all nozzles.

6. The method of claim 1 wherein the optical density parameter for each nozzle is a function of the average dot size produced on a receiver material by the nozzle.

7. The method of claim 1 wherein the optical density parameter for each nozzle is the average dot size produced on a receiver material by the nozzle divided by the average dot size produced on a receiver material by all nozzles.

8. The method of claim 1 wherein the optical density parameter for each nozzle is a function of the optical density measured from a raster line printed on a receiver material by the nozzle.

9. The method of claim 1 wherein element a) further includes:

i) determining a normalized optical density parameter for each nozzle as the optical density parameter for the nozzle divided by the average optical density parameter for all nozzles;

ii) determining a polynomial fit of the normalized optical density parameter for each nozzle vs. nozzle number; and iii) replacing the optical density parameter for the nozzle with the value of the polynomial fit evaluated at the corresponding nozzle number.

10. The method of claim 1 wherein element c) further includes multiplying each pixel in the given raster line by the line correction factor to produce the modified digital image.

11. The method of claim 1 wherein the printhead contains multiple columns of nozzles, and the optical density parameter for each nozzle is determined using a polynomial fit of the optical density parameter vs. nozzle number for each column of nozzles.

12. The method of claim 1 wherein element b) further includes:

i) determining a first line correction factor each raster line in a group of raster lines surrounding the given raster line;

ii) determining a polynomial fit of the first line correction factor vs. raster line number; and iii) replacing the line correction factor for the nozzle with the value of the polynomial fit evaluated at the corresponding raster line number.

13. A color inkjet printer having multiple colorants wherein the method of claim 1 is applied to image data for one or more of the colorants.

14. An inkjet printer having at least one printhead module containing two or more individual printheads wherein the method of claim 1 is applied to at least one printhead module.

* * * * *

UNITED STATES PATENT AND TRADEMARK OFFICE

CERTIFICATE OF CORRECTION

PATENT NO. : 6,830,306 B2
DATED : December 14, 2004
INVENTOR(S) : Douglas W. Couwenhoven et al.

It is certified that error appears in the above-identified patent and that said Letters Patent is hereby corrected as shown below:

Column 9,
Line 65, delete "each pixel"

Signed and Sealed this

Twelfth Day of April, 2005

JON W. DUDAS
*Director of the United States Patent and Trademark Office*